United States Patent [19]

VanKirk

[11] Patent Number: 4,928,974

[45] Date of Patent: May 29, 1990

[54] GOLF SWING TRAINER

[76] Inventor: Raymond J. VanKirk, 5370 Folks Rd., Horton, Mich. 49246

[21] Appl. No.: 326,734

[22] Filed: Mar. 21, 1989

[51] Int. Cl.[5] ..... A63B 69/36

[52] U.S. Cl. ..... 273/186 R; 273/191 A

[58] Field of Search ..... 273/186 R, 191 A, 191 R, 273/183 A, 192, 186 C, 188 R, 190 R

[56] References Cited

U.S. PATENT DOCUMENTS

| | | | |
|---|---|---|---|
| 1,005,948 | 10/1911 | English | 273/191 R |
| 1,567,530 | 12/1925 | MacNaughton et al. | 273/191 R |
| 1,944,942 | 1/1934 | MacDonald | 273/191 A |
| 2,520,287 | 8/1950 | Plunkett et al. | 273/191 A |
| 2,713,491 | 7/1955 | Plunkett et al. | 273/191 A |
| 2,756,056 | 7/1956 | Zega | 273/191 A |
| 2,933,681 | 4/1960 | Crain | 273/186 R |
| 3,339,927 | 9/1967 | Nunn | 273/191 R |
| 3,341,208 | 9/1967 | Marcella | 273/191 A |
| 3,583,707 | 6/1971 | Fujimoto | 273/191 A |
| 4,071,251 | 1/1978 | Beckish | 273/191 A |
| 4,659,084 | 4/1987 | Vuick | 273/190 R |

*Primary Examiner*—George J. Marlo

*Attorney, Agent, or Firm*—Beaman & Beaman

[57] ABSTRACT

A training device for golfers to aid the golfer in developing a consistent and properly oriented golf club swing. A plurality of cantilever supported feelers of a flexible nature are so mounted on a ring mounted on a column support that the free end of the feeler elements are located in a predetermined position to the golfer whereby departure of the golf club path of movement from the proper path will cause the golf club shaft to engage a feeler free end and indicate to the golfer correction is required.

8 Claims, 1 Drawing Sheet

GOLF SWING TRAINER

BACKGROUND OF THE INVENTION

The path of movement of a struck golf ball is primarily determined by the path of movement of the golf club prior to engaging the ball. Hence, a golf club moving through the proper path of movement will result in the struck ball being impelled in the desired direction with a minimum of "slice", "hook" or other objectionable spin being imparted to the ball. Most inconsistencies in the direction of the ball movement by golfers results from an improper and misoriented swing.

A number of golf club training and guiding devices have been proposed for training golfers with respect to maintaining the proper golf club movement while addressing and striking a golf ball. Reference is made to U.S. Pat. Nos. 1,567,530; 1,944,942; 2,520,287; 2,713,491; 2,756,056; 3,339,927; 3,341,208 and 3,583,707. Most of the aforementioned patents utilize rings and arc devices for aiding the golfer during the golf club swing and several of these devices utilize guides wherein the club may be connected to a ring or arc to indicate to the golfer the proper club swing movement.

While the prior art devices may provide some help to correct typical golfing problems, such devices are usually so rigid as to restrict the natural movements of the golfer, or so confining and inflexible as to discourage usage by the golf student. Further, many of the prior art devices are too large, heavy and expensive to be portable and are impractical and incapable of commercial distribution.

It is an object of the invention to provide a golf club swing trainer wherein the apparatus permits the golfer to be comfortable and utilize the golfers most natural swing movement and yet indicate to the golfer where problems exist to permit correction.

Another object of the invention is to provide a golf club swing trainer which may be easily used by a wide variety of golfers of various sizes and which permits the golfer to use the device without unusual skills or complex instruction.

A further object of the invention is to provide a golf club swing trainer which is of a lightweight, easy to ship and transport, and having components which may assembled without extraordinary skills or special tools.

In the practice of the invention a bracket is mounted upon a vertically oriented support column having an annular ring adjustable mounted thereto. A pair of feeler elements are mounted upon the ring each having an elongated configuration and cantilever mounted upon the ring whereby the free end of the feeler element may be struck by a moving golf club shaft without damage to either the club or the feeler, and indicates to the golfer an improper orientation of the club shaft during the swing.

The feeler elements, two of which are usually employed, may be of an elongated relatively rigid construction resiliently or flexibly mounted to the ring, or the feeler element itself may be formed of a resilient and flexible material.

During use, the golfer is positioned adjacent the ring and the feeler elements in such a manner that the correct swing movement will locate the club shaft close to the feeler element's free ends, but not engaging the same. Engagement between a feeler element and the golf club shaft indicates that the golf club has been swung too close to the feeler and ring and the golfer may make adjustments during subsequent golf swings to compensate for the incorrect club movement during swinging and observe the "feel" of a properly oriented swing.

The components of the invention are economically produced, and the trainer parts may be readily disassembled for shipping and storage and easily assembled.

BRIEF DESCRIPTION OF THE DRAWINGS

The aforementioned objects and advantages of the invention will be appreciated from the following description and accompaning drawing wherein.

DESCRIPTION OF THE PREFERRED EMBODIMENT

Figure 1:
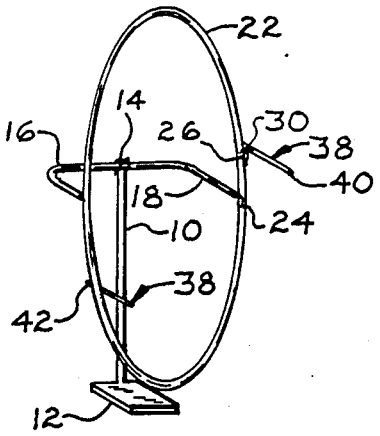
FIG. 1 is a perspective view of a golf club swing trainer in accord with the invention.

A trainer in accord with the concepts of the invention includes a vertically extending support consisting of a column 10 having a lower end affixed to a base 12. In the figures, the base 12 is represented as a generally planer block, and may consist of a weighted base of the illustrated configuration, but it is to be understood that the lower end of the column 10 could be pointed as to be inserted into the ground, or the column maybe otherwise supported in any conventional manner so as to be generally vertically oriented.

At its upper end, the column 10 includes a clamp 14 utilizing wing nuts or threaded fasteners for adjustable or frictionally holding the bracket base 16. The bracket base 16 includes pair of spaced parallel legs 18 each terminating at its outer end with a pivot supporting adapter 20 whereby the bracket legs 18 support the annular ring 22 through holes or other structure defined in the ring at generally diametrical locations.

The ring 22 constitutes a feeler support, and while it could be formed of a single member of metal or synthetic plastic, preferably, the ring 22 is formed by three or four synthetic plastic rod-like elements each having an end socket whereby the elements may be assembled into the annular ring configuration and yet may be easily packaged for shipment and handling purposes.

Figure 4:
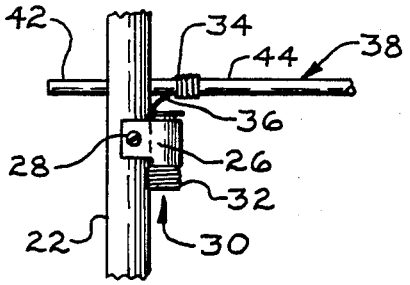
FIG. 4 is an enlarged, detailed, elevational view of the ring socket and inner end of a feeler element in a normal relationship.

A pair of socket clamps 26 are attached to the annular ring 22 each by a screw 28 extending into the ring, as will be appreciated from FIG. 4. The socket 26 may be of the form of a conventional plastic pipe clamp and includes a cylindrical portion which defines a cylindrical socket. As will be appreciated from the drawings, one of the socket clamps 26 is located above its associated bracket leg 18, while the other socket clamp is located below its nearest bracket leg 18.

Each of the socket clamps 26 is associated with a tension spring 30 consisting of a pluralality of wire coils wherein adjacent coils are contiguously related. The lower coils are represented at 32 and are located within the socket 26, while the upper coils are represented at 34, FIG. 4, defining a cylindrical tubular configuration. The coil portions 32 and 34 are connected by an interconnecting coil 36 which has been deformed from its normal configuration and comprises a flexible hinge or connecting element between the coil portions 32 and 34.

A feeler element 38 is inserted within each of the coil portions 34 as will be appreciated from FIG. 4. In the disclosed embodiment of the invention the feeler elements comprise quarter-inch wood doweling and are of such a diameter as to be snugly received within the coil portion 34, and yet, upon sufficient axial force being applied to the feeler element the element will slide within the coil portion 34 for axial adjustment therein.

The feeler elements 38 each include an outer end 40 and an inner end 42. The element central region 44 is defined intermediate the outer and inner ends.

In the normal arrangement, the coil porton 34 will be located relatively close to the inner end 42 as shown in FIG. 4 providing a cantilever support of the element 38 and the ends 40 may be defined as a free cantilever supported end.

Figure 2:
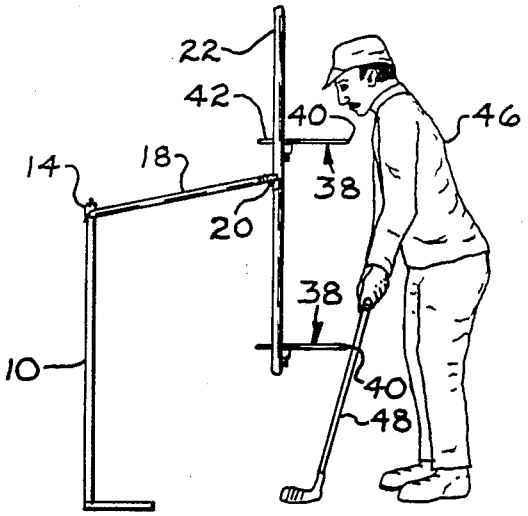
FIG. 2 is a side elevational of the trainer illustrating a golfer holding a golf club in a typical stance relative to the trainer during use.
Figure 3:
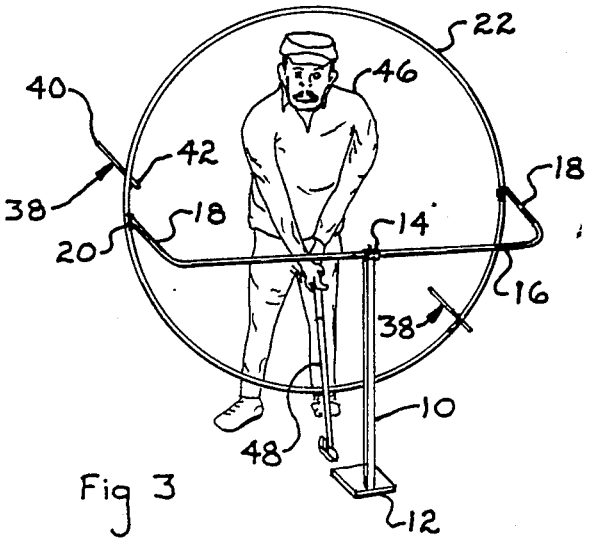
FIG. 3 is also an elevational view of a golfer positioned relative the trainer during use, the view being taken from the front of the golfer.

In typical usage, the bracket base 16 is oriented to the column 10 and the ring 22 is oriented to the bracket legs 18 as shown in FIGS. 1–3. In this manner the ring 22 is substantially vertical as will be apparent in FIG. 2. The feeler elements 38 are positioned within their associated spring coil portions 34 wherein the element ends 40 extend significantly to the right of the plane of the ring 22, such as about 12 inches.

The golfer positions himself, "in front of" the ring 22 as shown in FIG. 2 and, depending upon which club is being used, and the natural and correct position of the golfer to a golf ball, the golfer will be spaced from the plane of the ring 22 such that with the correct golf club swing the golf shaft 48 will be moved adjacent to the feeler element ends 40 without touching the same. During the golfers backswing, and during the forward golf swing, the golfer is able to accurately sense the location of the golf club shaft to the feeler element ends 40, and if the golf club shaft 48 engages the element's ends 40 during the golf swing such engagement is readily sensed by the golfer and will laterally deflect the struck feeling element without damage thereto in view of the resilient nature of the support for the feelers 38 as provided by the coil 36.

As will be appreciated from FIG. 2, the golf ball to be struck will be located below the ring 22, and as the ends 40 of the elements 38 are usually in the same vertical plane parallel to the ring 22 the training device greatly aids the golfer in maintaining a consistent swing. With the feeler elements 38 positioned as illustrated in the drawings, the right element 38, FIG. 1, will indicate the position of the golf club shaft as the golf club head approaches the ball, while the left feeler element is particular useful in sensing the position of the golf club after impact with the ball would have occured.

The device of the invention permits the golfer to move his body in the most natural and comfortable manner, without restraint, yet the presence of the ring 22 in front of the golfer, and the presence of the feeler element's ends 40 such as to engage the golf club shaft if the golf club shaft is moved too close to the ring during movement, trains the golfer to realize what a correct golf club swing feels like and the "restraint" achieved by the trainer with respect to influence upon the golfer is primarily mental as compared with many of the prior art devices which physically restrain the golfers movement during swinging and such devices are rarely successful in correcting faults.

Figure 5:
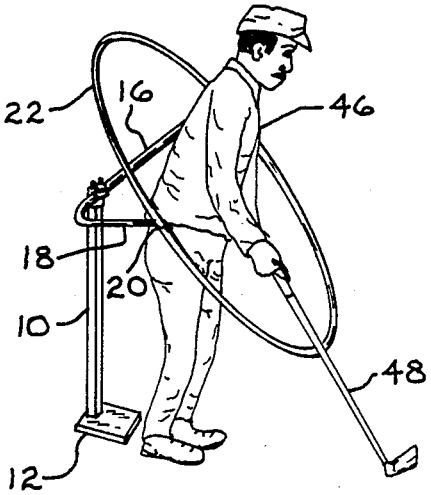
FIG. 5 illustrates another manner in which the golf swing trainer of the invention may be used to keep the swing relatively planar, the feeler elements not being employed.

FIG. 5 illustrates another manner in which the apparatus of the invention may be used. By tilting the annular ring 22 about the pivot ends 20 of the bracket legs 18 the annular ring may be obliquly oriented to the vertical and the golfer may position himself inside the ring as shown. The feeler elements 38 are removed from the ring, and the golf club shaft 48 is located "outside" the ring and as the golfer swings at a real or imaginary ball the golfer will observe and sense the proximity of the golf club shaft to the ring 22 during the swinging movement thereby producing a golf club shaft swing which is substantially "planar" resulting in a more accurately driven golf ball.

In the illustrated embodiment the feeler elements 38 comprise cylindrical rods of relatively rigid material, such as wood dowel rod. However, it is to be understood that the feeler elements 38 could be formed of a flexible resilient material capable of deflection wherein the feeler rod could be rigidly mounted to the ring 22 and the deflection occuring in the feeler element upon being struck by the moving golf club shaft would result from deforming and flexing of the rod material itself. In such instance a synthetic plastic material would be most suitable material for forming the feeler element.

It is appreciated that various modifications to the inventive concepts may be apparant to those skilled in the art without departing from the spirit and scope of the invention.

I claim:

1. A golf swing trainer comprising, in combination, a vertically extending support, feeler support means mounted on said support having a configuration defining the desired path of movement of a golf club swing, and at least a pair of spaced feelers mounted upon said support means, each of said feelers comprising a lightweight elongated element having first and second ends, said elements each being cantilever mounted upon said support means remotely from said first ends, and said first ends being resiliently laterally deflectable whereby engagement of said element first ends by a swung golf club will cause the engaged ends to be momentarily deflected without damage to said elements, and said engagement will be sensed by the golfer, said elements being sufficiently spaced apart on said support means to indicate to the golfer departure of the golf club swing from said desired planar path of movement upon said elements being engaged.

2. In a golf swing trainer as in claim 1, said elongated elements being relatively rigid, and a reslient mount connecting each of said elements to said feeler support means permitting lateral deflection of said elements relative to said support means.

3. In a golf swing trainer as in claim 2, said resilient mount comprising a coil spring.

4. In a golf swing trainer as in claim 3, said coil spring . being attached to the associated element adjacent said second end thereof.

5. In a golf swing trainer as in claim 3, said feeler support means including a socket, said feeler elements comprising a cylidrical rod, said coil spring being of the tension type having a cylindrical body defined by a plurality of adjacent contiguous coils having first and second ends, a plurality of said coils adjacent said first end of said spring being received within said socket and a plurality of coils adjacent said second end of said spring embracing said rod adjacent said rod's second end.

6. In a golf swing trainer as in claim 1, said elongated elements being formed of a flexible, resilient material.

7. In a golf swing trainer as in claim 1, said feeler support means comprising an annular ring, and an adjustable bracket attaching said ring to said vertically extending support whereby said ring may be selectively positioned relative to said support.

8. In a golf swing trainer as in claim 7, said ring being of a planar configuration.

* * * * *